United States Patent [19]

Triner et al.

[11] Patent Number: 4,679,879

[45] Date of Patent: Jul. 14, 1987

[54] PLUG AND RECEPTACLE CONNECTOR ASSEMBLY

[75] Inventors: Irvin R. Triner, Stickney; Craig A. Bixler, Elmhurst, both of Ill.

[73] Assignee: Molex Incorporated, Ill.

[21] Appl. No.: 914,892

[22] Filed: Oct. 3, 1986

[51] Int. Cl.[4] ..... H01R 4/24

[52] U.S. Cl. ..... 439/425; 439/607

[58] Field of Search ..... 339/97 R, 97 P, 98, 339/99 R, 143 R

[56] References Cited

U.S. PATENT DOCUMENTS

| | | | |
|---|---|---|---|
| 4,278,314 | 7/1981 | Moser et al. | 339/99 R |
| 4,344,665 | 8/1982 | Racilla et al. | 339/99 R |
| 4,569,566 | 2/1986 | Triner | 339/99 R |

*Primary Examiner*—Joseph H. McGlynn

*Attorney, Agent, or Firm*—Louis A. Hecht; John W. Cornell

[57] ABSTRACT

A plug and receptacle connector assembly is used for interconnecting the conductors of a flat high density cable to circuits on a printed circuit board or the like. The plug contains a first set of contacts disposed on one side of the cable, each of which pierce the cable in order to make contact with alternate ones of the conductors. A second set of plug contacts are disposed on the other side of the cable and each of these plug contacts pierce the cable to make electrical contact with the other ones of the conductors in the cable. The plug contacts are L-shaped with the insulation piercing portions forming one of the legs of the L-shaped contacts. The insulation piercing portions of the plug contacts in the first set of contacts are positioned in a row closer to the rear end of the plug than the insulation piercing portions of the plug contacts in the second set of plug contacts. The plug is adapted to be received in a plug receiving cavity in the receptacle which has first and second sets of receptacle contacts, each of which are adapted to mate with one of the plug contacts in the first and second sets of plug contacts. The plug may have a latch mechanism to maintain the plug properly disposed in the plug receiving cavity of the receptacle. Alternatively, the plug and the receptacle include metallic shields. The metallic plug shield is coupled to a shield of the cable and the receptacle has fingers projecting into the plug receiving cavity so that when the plug is inserted into the plug receiving cavity the fingers make contact with the shield of the plug and maintain the plug in the plug receiving cavity.

17 Claims, 5 Drawing Figures

PLUG AND RECEPTACLE CONNECTOR ASSEMBLY

BACKGROUND OF THE INVENTION

1. Field of the Invention

The present invention relates to a plug and receptacle connector assembly, and more particularly, to a new and improved plug and receptacle connector assembly for high density, flat type cables in which the distance between the center-lines of adjacent conductors is extremely small, such as 0.025 inches.

2. Description of the Prior Art

Modular type plug and receptacle connectors are used in the telephone and digital electronics industries to electrically interconnect telephone or telecommunication cables. The plug is typically attached to an end of a cable and includes contacts which pierce the insulation surrounding the conductors in the cable so as to be coupled to the conductors in the cable. On the other hand, the receptacle may be adapted to be mounted on a printed circuit board or the like. The receptacle includes a receptacle housing having a plurality of contacts. One end of each of the contacts forms a spring contact extending into a plug receiving cavity of the housing and the other end of each contact forms a tail portion which is inserted through holes in the printed circuit board such that the receptacle contacts can be connected to electric circuits on the printed circuit board. When the plug is inserted into the plug receiving cavity of the receptacle housing, the plug contacts slidingly mate with the spring contact portions of the receptacle contacts. As a result, the plug and receptacle form a interface between the conductors in the cable and the circuits on the printed circuit board.

The cable to which the plug is connected may be a flat type cable having a plurality of conductors, each of which is surrounded by insulation. The insulated conductors are in turn surrounded by a shield member and an outer jacket to form the conductors as a cable. One example of such a plug and receptacle connector assembly which can be used with such a cable is disclosed in Triner U.S. Pat. No. 4,569,566 assigned to the assignee of the present application.

In certain types of applications, high density flat type cables are used. These cables have a center-line to center-line spacing between the conductors of approximately 0.025 inches. For example, such cables may be used with printers and computer peripherals. This center-line to center-line spacing is significantly less than the center-line to center-line spacing of cables which might be used with the plug and receptacle assembly disclosed in U.S. Pat. No. 4,569,566. When the center-line to center-line spacing becomes so small, the spacing between adjacent contacts in the plug and receptacle is decreased. As a result, the distance between adjacent contacts in the plug and receptacle is not large enough for the air between the contacts to maintain sufficient insulation between adjacent contacts.

SUMMARY OF THE INVENTION

Accordingly, one object of the present invention is to provide a new and improved plug and receptacle connector assembly for use with high density, flat cables, particularly those with as little as 0.025 inches spacing between the center-lines of adjacent conductors.

It is another object of the present invention to provide a new and improved plug and receptacle assembly having sufficient spacing between adjacent contacts even when used with high denisty, flat cables.

It is still another object of the present invention to provide a new and improved plug and receptacle connector assembly wherein adjacent contacts are on opposite sides of the cable in order to provide increased isolation between adjacent contacts.

It is a further object of the present invention to provide a new and improved plug and receptacle connector assembly having contacts in the plug with barbs which pierce into the conductors of the cable, the barbs on adjacent contacts being offset from each other.

In accordance with these and many other objects, an embodiment of the present invention comprises a plug and receptacle connector assembly for interconnecting the conductors of a flat, high density cable to circuits on a printed circuit board or the like. The plug includes a plug housing having a mating or front end and a rear end from which extends a cable receiving cavity for receiving a portion of the flat insulated cable. The cable is formed of a plurality of conductors encased in insulation and disposed in side-by-side spaced apart relationship. The plug has a first set of contacts disposed along a top portion of the cable receiving cavity so that an insulation piercing portion on each of the contacts pierces through the insulation surrounding the conductors and makes electrical contact with alternate ones of the conductors. A second set of plug contacts are disposed along the bottom portion of the cable receiving cavity and each of the plug contacts in this second set of plug contacts has an insulation piercing portion which makes electrical contact with the other ones of the conductors in the cable. As a result, the plug contacts in the first set of plug contacts are disposed midway between the plug contacts in the second set of plug contacts permitting adjacent plug contacts to be spaced further apart than adjacent conductors in the cable. Consequently, an adequate distance can be maintained between the plug contacts for proper insulation even though the center-line to center-line spacing of the adjacent conductors is very small (for example, 0.025 inches). In order to provide even further insulation between the plug contacts, the plug contacts are generally L-shaped with the insulation piercing portion of the plug contact forming one of the legs of the L-shaped contact. By having the insulation piercing portions of the plug contacts in the first set of contacts positioned closer to the rear end of the plug than the insulation piercing portions of the plug contacts in the second set of plug contacts, additional insulation between adjacent contacts is obtained.

The plug is adapted to be received through a plug receiving opening in the front or mating end of the receptacle into a plug receiving cavity. A first set of receptacle contacts extend from the top portion of the plug receiving cavity so that one of the first set of receptacle contacts mates with one of the plug contacts in the first set of plug contacts. Similarly, a second set of receptacle contacts extend adjacent the bottom portion of the plug receiving cavity so that individual ones of these receptacle contacts mate with one of the contacts in the second set of plug contacts.

In one embodiment of the present invention, the plug has a latch mechanism to maintain the plug properly disposed in the plug receiving cavity. In another embodiment of the present invention, a metallic shield surrounds the rear portion of the plug housing and a finger contact couples the plug shield to a metallic shield of the cable. The receptacle also has a metallic ground shield with fingers projecting into the plug receiving cavity such that when the plug is inserted into the plug receiving cavity, the fingers make contact with shield of the plug and maintain the plug in the plug receiving cavity.

BRIEF DESCRIPTION OF THE DRAWING

Many other objects and advantages of the present invention will become apparent from considering the following detailed description in conjunction with the drawings in which.

DETAILED DESCRIPTION OF THE PREFERRED EMBODIMENT

Figure 1:
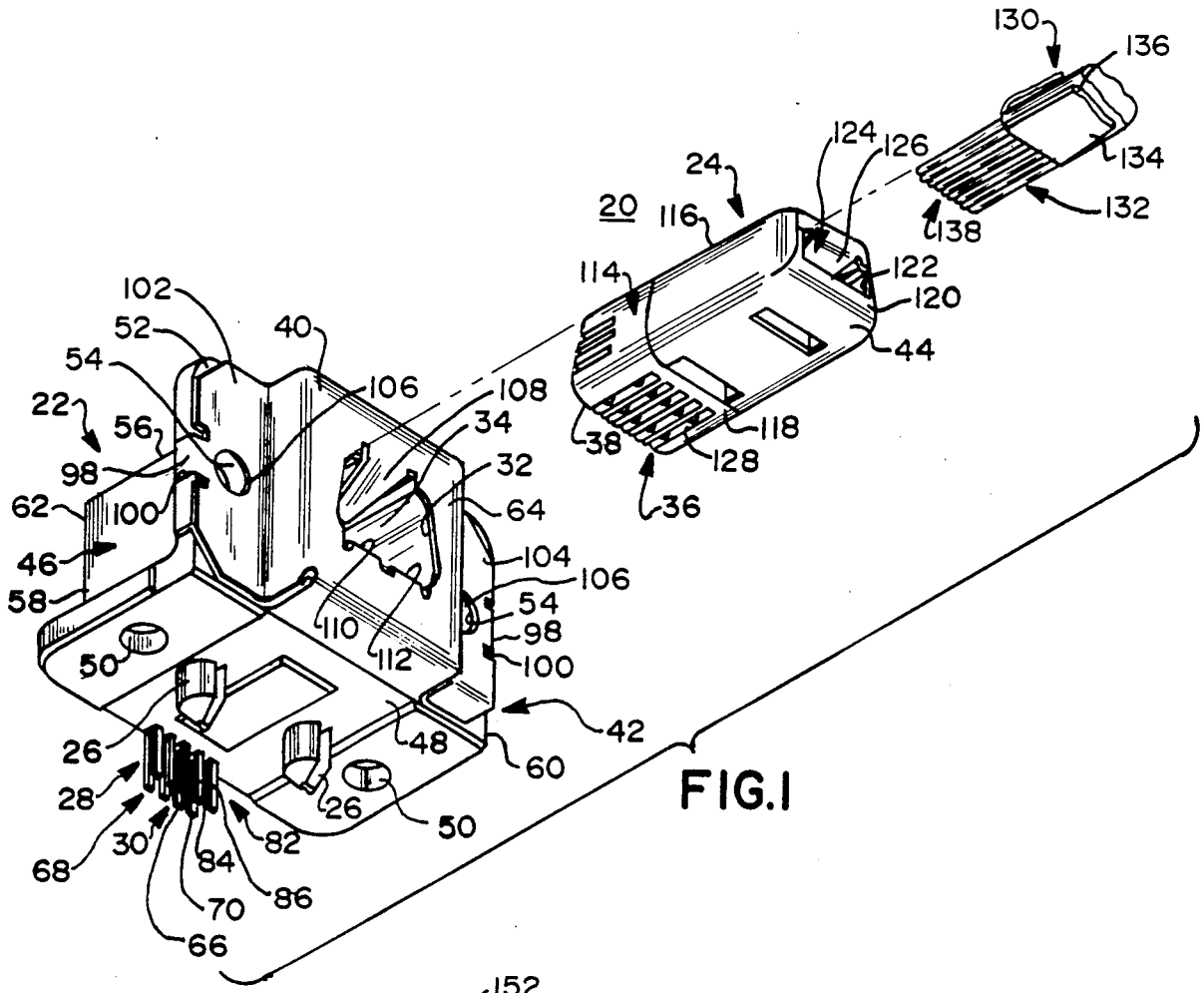
FIG. 1 is perspective, partially exploded view of a shielded plug and receptacle connector assembly embodying the present invention.
Figure 2:
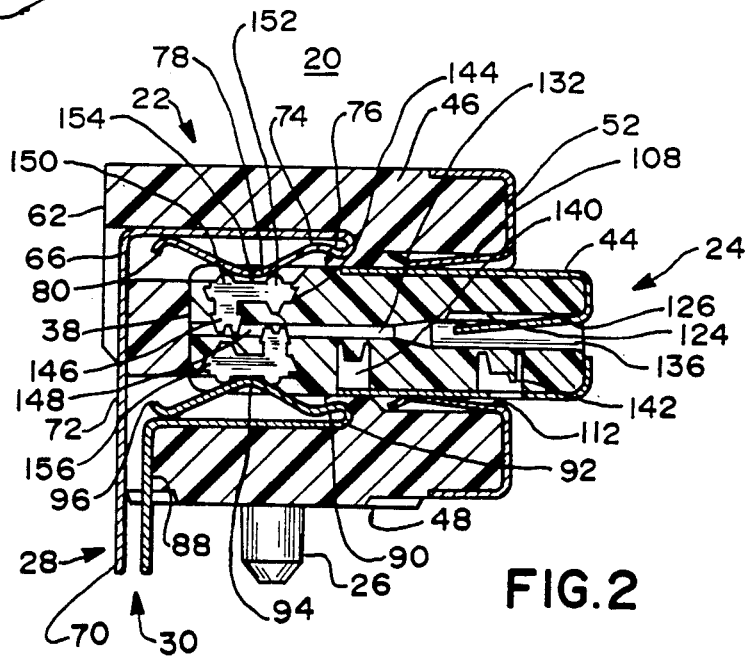
FIG. 2 is a cross sectional view of the plug and receptacle connector assembly disclosed in FIG. 1 with the plug and receptacle mated together.

Referring now more specifically to FIGS. 1–2 of the drawings, therein is disclosed a plug and receptacle connector assembly which is generally designated by the numeral 20 and which embodies the present invention. The connector assembly 20 includes a receptacle 22 and a plug 24. The receptacle 22 is adapted to be mounted on a printed circuit board (not shown) such that mounting posts 26 will extend through positioning holes in the printed circuit board and tail portions 28 of contacts 30 extending from the receptacle 22 will project through other holes in the printed circuit board so as to be coupled by soldering or the like to circuits on the printed circuit board. The receptacle 22 has a plug receiving opening 32, the outer peripheral shape of which conforms to the outer peripheral shape of the plug 24 so that the plug 24 may be inserted through the plug receiving opening 32 into a plug receiving cavity 34 in the receptacle 22.

The plug 24 as positioned in the plug receiving cavity 34 is illustrated in FIG. 2. The plug 24 has contacts generally indicated as 36 disposed near its mating end 38. When the plug 24 is inserted into the plug receiving cavity 34, the contacts 36 wipingly engage corresponding ones of the contacts 30 in the receptacle 22. The plug and receptacle connector assembly 20 disclosed in FIGS. 1 and 2 is a shielded type. The receptacle 22 has a shield 40 covering its outer front or mating end 42 and the plug 24 has a shield 44 about a portion of its outer periphery. When the plug 24 is inserted into the receptacle 22, electrical grounding contact will be established between the shields 40 and 44 (see FIG. 2).

The receptacle 22 includes a dielectric housing 46 with an outer bottom wall 48. The mounting posts 26 extend outwardly from the bottom wall 48 so that the receptacle 22 may be mounted on a printed circuit board with the mounting posts 26 extending through corresponding holes in the printed circuit board. The bottom wall 48 also has mounting holes 50 so that the housing 46 can be secured to a printed circuit board. A front wall 52 of the housing 46 projects transverse to the bottom wall 48. The front wall 52 forms the mating end 42 of the receptacle 22. The front wall 52 also has a pair of mounting holes 54 so that the housing 46 may be secured to mounting panels, chassis structures and the like. The housing 46 also includes a top wall 56 opposed to the bottom wall 48, opposed side walls 58 and 60 and a rear wall 62. The walls 48, 52, 56, 58, 60 and 62 of the housing 46 form the plug receiving cavity 34 with the plug receiving opening 32 being disposed in a front projecting portion 64 of the front wall 52.

The receptacle housing 46 has the plurality of contacts 30 mounted therein. In the disclosed embodiment of FIGS. 1 and 2, nine such contacts 30 are disposed in the housing 46. As illustrated in FIG. 2 in connection with a contact 66, four of the contacts 30 form a set of contacts 68, each of which has a tail portion 70 extending from the bottom wall 48. An intermediate portion 72 of the contact 66 extends along the rear wall 62. The intermediate portion 72 is bent at a generally right angle so that it also extends along the inner portion of the top wall 56 towards the front end or mating end 42 of the receptacle housing 46. The contact 66 is then reversely bent so that a spring portion 74 is formed along the top portion of the plug receiving cavity 34 and extends rearwardly toward the rear wall 62. As more specifically disclosed in U.S. Pat. No. 4,569,566, the spring contact portion 74 includes a cantilevered contact portion 76 with a concave region 78 adjacent a free end 80. The concave portion 78 is adapted to engage one of the contacts 36 in the plug 24 when the plug 24 is positioned in the plug receiving cavity 34.

Another set 82 of five contacts 30 are positioned in the receptacle housing 46. As illustrated in connection with contact 84, each of these five contacts 82 has a tail portion 86 extending out from the bottom wall 48 of the housing 46. An intermediate portion 88 of the contact 84 extends along the lower portion of the rear wall 62 and is bent at a generally right angle so that it also extends along the inner portion of the bottom wall 48 towards the front end 42 of the receptacle housing 46. The contact 84 is then reversely bent so that a spring portion 90 is formed along the bottom portion of the plug receiving cavity 34. As was the case with respect to the spring portion 74, the spring portion 90 includes a cantilevered contact portion 92 with a concave region 94 adjacent a free end 96. The concave portion 94 is adapted to engage one of the contacts 36 of the plug 24 when the plug 24 is positioned in the plug receiving cavity 34.

As is seen in FIGS. 1 and 2, the tail portions of the contacts in the set of contacts 68, such as the tail portion 70 of contact 66, are in alignment between the side walls 58 and 60 of the housing 46 and the tail portions of the set of contacts 82, such as the tail portion 86 of the contact 84, are also in alignment between the side walls 58 and 60. The tail portions of the contacts 82 are positioned forward or toward the mating end 42 as compared to the tail portions of the contacts 68. The positioning of the tail portions of the sets of contacts 68 and 82 are designed in this pattern so as to project through corresponding holes on a printed circuit board or the like. Moreover, by so staggering the tail portions of the contacts 68 and 82, a greater distance is maintained between adjacent contacts.

In the embodiment disclosed in FIGS. 1 and 2, the front end 42 of the receptacle housing 46 is covered by the receptacle shield 40. The shield 40 is metallic and is secured to the mating face 42 of the receptacle housing 46 by tangs 98 which are wrapped into recesses 100 in the side or ear portions 102 and 104 of the mating face 42. In addition, the shield 40 has securing portions 106 drifted into the mounting holes 54 in ear portions 102 and 104. The shield 40 also has a cantilevered finger 108 adjacent the top of the plug receiving opening 32 which projects into the plug receiving cavity 34 and a pair of cantilevered fingers 110 and 112 projecting adjacent the bottom of the plug receiving opening 32 into the plug receiving cavity 34. As described in more detail below, the fingers 108, 110 and 112 contact the shield 44 on the plug 24 when it is received in the plug receiving cavity 34 so that electrical ground contact is established between the shields 40 and 44 when the plug 24 is positioned in the plug receiving cavity 34.

Turning now to the plug 24, the plug 24 is formed of a dielectric housing 114 having a bottom wall 116, a top wall 118, a rear wall or conductor receiving end 120 and the mating end 38. The portion of the plug housing 114 adjacent to the rear end 120 is covered by the plug shield 44. The rear wall 120 has a cable receiving opening 122 which extends into a cable receiving cavity 124. The shield 44 includes a grounding finger contact 126 which extends through the opening 122 into the cable receiving cavity 124.

The contacts 36 of the plug 24 are positioned adjacent the mating end 38 of the plug housing 114. The contacts 36 are disposed in contact receiving cavities 128 which extend from the bottom wall 118 into the cable receiving cavity 124. Similar type cavities 128 are provided in the top wall 116 of the plug housing 114 for the contacts 36 extending from the top wall 116 of the plug housing 114.

The plug 24 is adapted to receive a cable 130 through the cable receiving opening 122 such that the cable 130 will be positioned in the cable receiving cavity 124 so that the contacts 36 can be coupled to individual conductors 132 in the cable 130. The cable 130 disclosed in FIG. 1 of the drawing includes the insulated conductors 132. In the disclosed embodiment, the cable 130 contains nine such conductors 132. A cable shield 134 surrounds the conductors 132 and the shield 134 is in turn encased in an outer insulating jacket 136. As can be seen in FIG. 1 of the drawing, an end 138 of the cable 130 is prepared for insertion into the plug housing 114 by stripping a portion of the outer jacket 136 and by folding over the jacket 136 a portion of the cable shield 134. The prepared end 138 is then inserted through the cable receiving opening 122 into the cable receiving cavity 124. When the cable end 138 is so inserted into the plug housing 114, the cable end 138 is positioned in the plug housing 114 as shown in FIG. 2 of the drawing. In order to maintain the cable end 138 in the cable receiving cavity 124, a conductor strain relief 140 and a jacket strain relief 142 are provided which contact the conductors 132 and the jacket 136, respectively, to maintain the end 138 of the cable 130 in the plug housing 114.

After the cable end 138 is so positioned in the plug housing 114, one of the contacts 36, for example a plug contact 144, may be inserted through one of the contact receiving cavities 128 such that an insulation piercing or barb portion 146 pierces one of the conductors 132 (as illustrated in FIG. 2, the barb portion 146 makes electrical contact with a conductor 148). The contact 144 is generally L-shaped with one leg thereof being the barb portion 146 and the base or other leg thereof having a pair of projections 150 and 152 so as to form a contact receiving recess 154 between the projections 150 and 152. As illustrated in FIG. 2, the concave region 78 of the spring portion 74 becomes lodged in the contact receiving recess 154 when the plug 24 is inserted into the plug receiving cavity 34. As described in more detail in U.S. Pat. No. 4,569,566, this configuration for the contact 144 and the spring portion 74 of the contact 66 provides an improved contact surface for coupling the receptacle contacts 30 to the plug contacts 36.

Other of the plug contacts 36 are positioned adjacent the bottom wall 118 of the plug housing 114. One such contact 156 is coupled to one of the conductors 132 adjacent to the conductor 148. As is apparent from FIG. 2, alternate ones of the conductors 132 are connected to the plug contacts 36 extending from the top 116 of the plug housing 114 whereas the plug contacts 36 extending from the bottom wall 118 of the plug housing 114 are coupled to the remaining ones of the conductors 132.

When the cable end 138 is positioned in the plug 24, the shield finger 126 contacts the shield 134 of the cable 130. As a result, an electrical grounding contact is established between the plug shield 44 and the shield 134 of the cable 130. The plug shield 44 also is grounded to the shield 40 of the receptacle 22 when the plug 24 is inserted into the plug receiving cavity 34. As best seen in FIG. 2, the top finger 108 of the shield 40 and the bottom fingers 110 and 112 of the shield 40 extend in a cantilivered manner into the front portion of the plug receiving cavity 34. As the plug 24 is inserted into the plug receiving cavity 34, the finger 108 wipingly engages the top of the shield 44 and the fingers 110 and 112 wipingly engage the bottom of the shield 44. Consequently, an electrical grounding contact is established between the shields 40 and 44 through the fingers 108, 110 and 112. Moreover, since the fingers 108, 110 and 112 extend diagonally into the plug receiving cavity 34 in a cantilevered manner, the pressure exerted on the plug 24 through the shield 44 by the fingers 108, 110 and 112 is sufficient to retain the plug 24 in the plug receiving cavity 34 without the necessity of a separate retaining mechanism such as a latch or the like.

Figure 3:
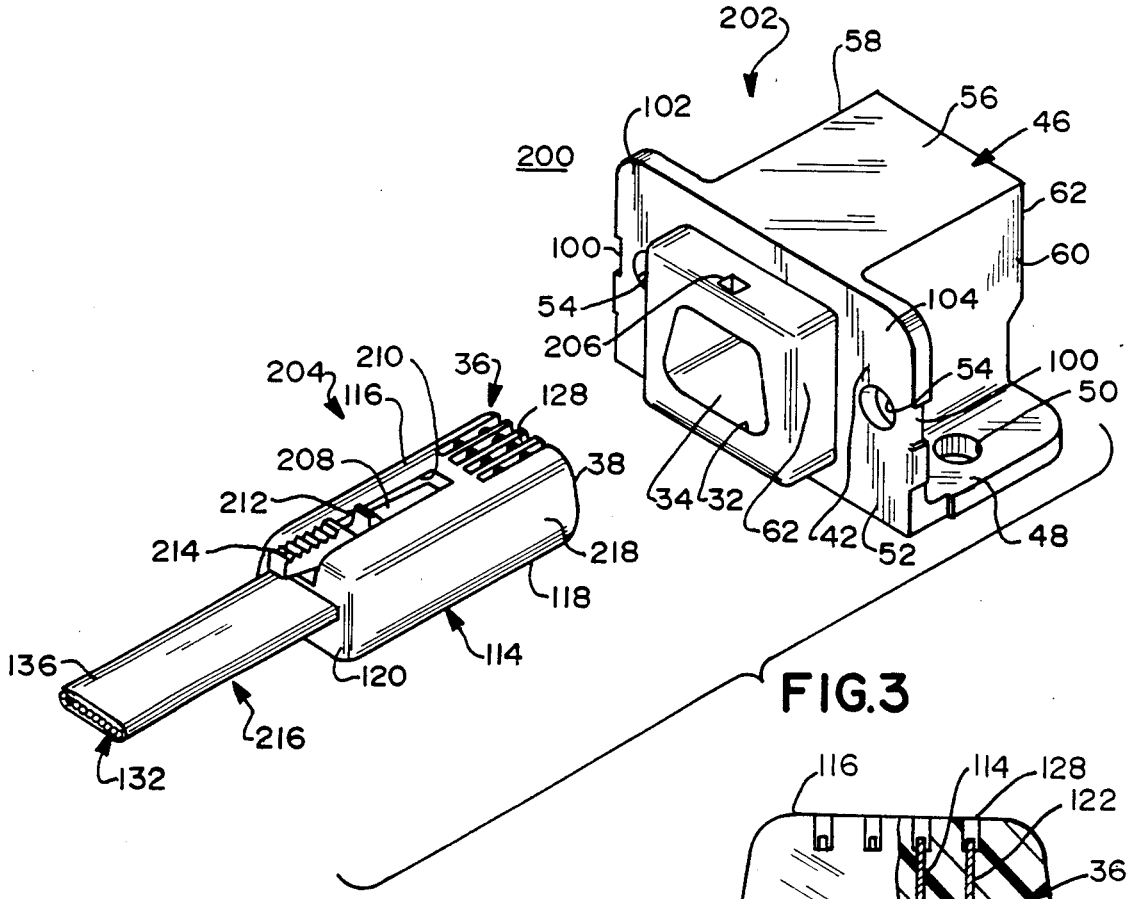
FIG. 3 is a perspective view of a plug and receptacle connector assembly similar to FIG. 1 except that no shielding is provided on the plug or receptacle.
Figure 5:
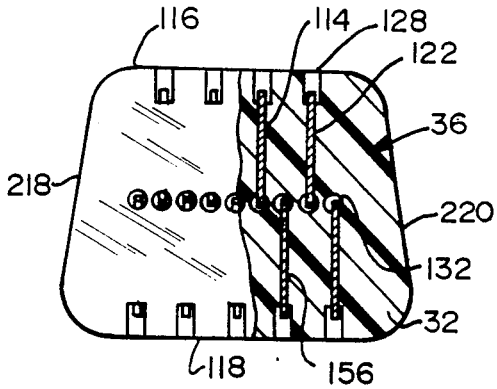
FIG. 5 is a front view of the plug disclosed in FIG. 3.
Figure 4:
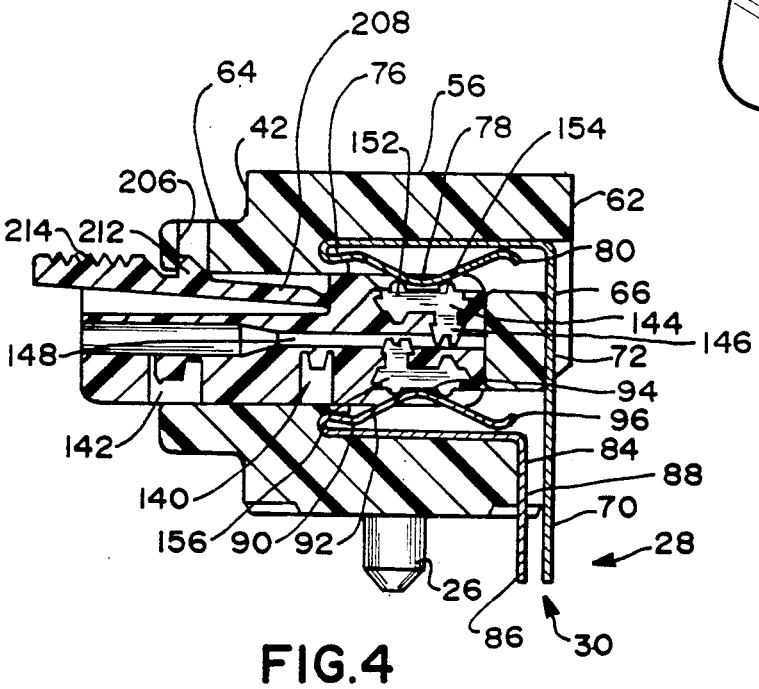
FIG. 4 is a cross sectional view of the plug and receptacle connector assembly disclosed in FIG. 3 with the plug and receptacle mated together.

Referring now to FIGS. 3–5, therein is disclosed a non-shielded version of a plug and receptacle connector assembly embodying the present invention, which assembly is generally designated by the numeral 200. The various portions of the plug and receptacle connector assembly 200 that are identical with corresponding portions of the plug and receptacle connector assembly 20 disclosed in FIGS. 1–2 are designated by the same reference numerals as those portions of the plug and receptacle connector assembly 20.

As was the case with the plug and receptacle connector assembly 20, the main components of the plug and receptacle connector assembly 200 is a receptacle 202 and a plug 204. For the most part, the receptacle 202 is the same as the receptacle 22 but does not include the receptacle shield 40 that covers the mating end 42 of the receptacle 22. The receptacle 202 does include a latch opening 206 in the projecting portion 64 of the front wall 52. This latch opening 206 projects into the plug receiving opening 32 (see FIG. 4).

The plug 204 is essentially the same as the plug 24 except that no shield like the plug shield 44 is provided to cover any portion of the plug housing 114. Since there is no shield member to retain the plug 204 in the plug receiving cavity 34, the plug 204 has a cantilevered thumb actuated latch member 208 which is disposed in a recess 210 in the top wall 116 of the plug 204. The latch 208 is depressed into the recess 210 as the plug 204 is inserted through the plug receiving opening 32. When the plug 204 is properly positioned in the plug receiving cavity 34, the beam action of the latch 208 causes the latch 208 to move toward the top wall 116 and a latch projection 212 becomes disposed in the latch opening 206. As a result, the latch 208 ensures that the plug 204 will remain properly positioned in the plug receiving cavity 34. If it is desired to remove the plug 204 from the receptacle 202, a thumb actuating portion 214 of the latch 208 may be depressed so as to release the latch projection 212 from the latch opening 206 and the plug 204 may be removed from the receptacle 202.

Unlike the shielded cable 130, a non-shielded cable 216 is coupled to the contacts 36 in the plug 204. While the cable 216 does not include a shield, such as the shield 134, it does include the conductors 132 and the outer insulating jacket 136. The cable end 138 is maintained in the plug 204 by the strain reliefs 140 and 142. When the plug 204 is inserted into the plug receiving cavity 34, the contacts 36 engage the receptacle contacts 30 in the same manner as was described with respect to the plug and receptacle connector assembly 20.

In FIG. 5 of the drawing, the front or mating end 38 of the plug 204 is disclosed. However, the disclosure of FIG. 5 equally applies to the plug 24 forming a part of the plug and receptacle connector assembly 20. As is apparent from FIG. 5, the outer peripheral shape of the plug 204 is generally trapezoidal and the plug receiving opening 32 in the receptacle 202 has a corresponding trapezoidal shape. Since the plug receiving opening 32 and the plug 204 have such a shape, the plug 204 is in effect polarized so that it cannot be inserted in an inappropriate orientation into the plug receiving cavity 34.

As is shown in FIG. 5, the contacts 36 are positioned so that the plane of each of the contacts, such as the contact 144, adjacent the top wall 116 of the plug 204 are offset with respect to and midway between each of the contacts, such as the contact 156, positioned near the bottom wall 118 of the plug 204. As a result, the distance between adjacent contacts is greater than the distance between the center-line to center-line spacing of the conductors 132. For example, even if the center-line to center-line spacing between adjacent conductors 132 is 0.025 inches, the spacing between adjacent contacts in the plug 204 (for example the contact 144 and a contact 222) can nevertheless be 0.050 inches. Advantageously, even though the spacing between the center-line of adjacent conductors 132 is very small in a densely packed cable, such as the cables 216 and 130, the distance between adjacent contacts 36 in the plugs 24 and 204 is nevertheless sufficient to provide adequate insulation between the contacts 36.

As can be seen in FIGS. 2 and 4 of the drawings, the L-shaped configuration of the contacts 36 also provides additional spacing between adjacent contacts 36 so that an adequate distance is present between the contacts 36 to provide sufficient insulation between the contacts 36. In this regard, each of the barb portions 146 of the contacts adjacent the top wall 116, such as the contacts 144 and 222, are closer to rear end 120 of the plug 204 than are barb portions of the contacts adjacent the bottom wall 118, such as the contact 156. Consequently, the positioning of some of the contacts 36 above the cable 216 and alternate ones of the contacts 36 below the cable 216 and the offsetting of the barb portions results in the contacts 36 being adequately separated even when the center-line to center-line distance between adjacent conductors 132 in the cable 216 is very small. Likewise, the distance between adjacent contacts 30 in the receptacles 22 and 202 along either the top wall 56 or the bottom wall 48 is correspondingly increased so that there is sufficient distance between the spring portions 72 in the set of contacts 68 and the spring portions 90 in the set of contacts 82.

Although the present invention has been described in connection with details of the preferred embodiments, many alterations and modifications may be made without departing from the invention. Accordingly, it is intended that all such alterations and modifications be considered within the spirit and scope of the invention as defined in the appended claims.

We claim:

1. An electrical plug for use with a flat insulated cable having a plurality of conductors in side-by-side spaced apart relationship, said plug comprising:

a dielectric plug housing with a first mating end and a second opposed conductor receiving end, oppositely facing plug walls, oppositely facing plug side walls, a receiving cavity disposed between said plug walls and extending from said second conductor receiving end for receiving a portion of said flat cable, a plurality of first plug contacts disposed in said plug housing adjacent one of said plug walls, each of said first plug contacts being coupled to one of said plurality of conductors in a first set of alternate conductors, a plurality of second plug contacts disposed in said plug housing adjacent to the other of said plug walls, each of said second plug contacts being coupled to one of said plurality of conductors in a second set of alternate conductors, a first set of contact planes, each of said plurality of first plug contacts being included in one of said first planes, and a second set of contact planes, each of second plurality of second plug contacts being included in one of said second contact planes, adjacent contact planes in said first and second set of contact planes being offset from each other in a direction between the side walls of said plug housing.

2. The electrical plug as set forth in claim 1 wherein said plurality of first plug contacts are disposed on one side of said cable and said plurality of second plug contacts are disposed on the opposite side of said cable.

3. The electrical plug as set forth in claim 1 wherein said first plurality of plug contacts includes four contacts and wherein said plurality of second plug contacts includes five contacts.

4. The electrical plug as set forth in claim 1 wherein each of said plurality of first and second plug contacts includes outwardly extending contact projections so as to form a contact receiving region therebetween.

5. The electrical plug as set forth in claim 1 wherein each of said plurality of first plug contacts is an L-shaped contact with an insulating piercing portion of each of said plurality of first plug contacts forming one leg of the L-shaped contact and each of said plurality of second plug contacts is an L-shaped contact with an insulating piercing portion of each of said plurality of second plug contacts forming one leg of the L-shaped contact.

6. The electrical plug as set forth in claim 5 wherein the insulating piercing portions of said plurality of second plug contacts are positioned a greater distance from said second conductor receiving end of said plug housing than the insulating piercing portions of said plurality of first plug contacts.

7. The electrical plug as set forth in claim 1 including metallic conductive plug shielding means surrounding a portion of said plug housing and wherein said cable includes a metallic cable shield.

8. The electrical plug as set forth in claim 7 wherein said plug shielding means includes contact fingers means which wipingly engages said plug shielding means so that an electrical grounding contact is established between said cable shield and said plug shielding means.

9. A plug and receptacle connector assembly for use with a cable having a plurality of conductors in side-by-side spaced apart relationship, said assembly comprising:

a plug means having first and second ends, opposed plug walls, opposed plug side walls, and a cable receiving cavity for receiving a portion of said cable, a plurality of first plug contacts extending into said cable receiving cavity on one side of said cable, each of said plurality of first plug contacts being adapted to be coupled to alternate ones of said conductors in said cable, a plurality of second plug contacts extending into said cable receiving cavity on the other side of said cable, each of said plurality of second plug contacts being adapted to be coupled to remaining ones of said conductors in said cable, a receptacle means having a plug receiving cavity adapted to receive said plug means, a plurality of first receptacle contacts disposed on one side of said plug receiving cavity, each of said plurality of first receptacle contacts being adapted to mate with one of said plurality of first plug contacts, and a plurality of second receptacle contacts disposed on the opposite side of said plug receiving cavity from said plurality of first receptacle contacts, each of said plurality of second receptacle contacts being adapted to mate with one of said plurality of second plug contacts.

10. The plug and receptacle connector assembly as set forth in claim 9 wherein said plug means includes a latch means and said receptacle includes a latch receiving means, said latch means engaging said latch receiving means when said plug means is inserted into said plug receiving cavity to maintain said plug means in said plug receiving cavity.

11. The plug and receptacle connector assembly as set forth in claim 9 wherein each of said plurality of first and second plug contacts have a pair of projections forming a contact receiving recess and each of said plurality of first and second receptacle contacts have a concave spacing portion which is adapted to be received in the contact receiving recess of one of said plurality of first and second plug contacts.

12. The plug and receptacle connector assembly as set forth in claim 9 wherein said outer peripheral shape of said plug means is trapezoidal and wherein said receptacle means has a plug receiving opening extending into said plug receiving cavity, the shape of said plug receiving opening conforms to the trapezoidal shape of said plug means.

13. The plug and receptacle connector assembly as set forth in claim 9 including plug shielding means covering a portion of said plug means, and a receptacle shielding means having finger means extending into said plug receiving cavity, said finger means making contact with said plug shielding means when said plug means is positioned in said plug receiving cavity.

14. The plug and receptacle connector assembly as set forth in claim 13 wherein said finger means includes cantilevered means that exert pressure against said plug means when said plug means is inserted into said plug receiving cavity.

15. A plug adapted to be connected to an insulated cable having a plurality of conductors in side-by-side relationship, said plug comprising:

a dielectric plug housing having first and second ends, opposed plug top and bottom plug walls, opposed plug side walls, and a cable receiving means in which a portion of said cable is disposed, a plurality of first plug contacts extending from said top plug wall into said cable receiving means, each of said plurality of first plug contacts having an insulation piercing portion for coupling to nonadjacent ones of said conductors in said cable, a plurality of second plug contacts extending from said bottom plug wall into said cable receiving means, each of said plurality of second plug contacts having an insulation piercing portion for coupling to other ones of said conductors in said cable.

16. The plug as set forth in claim 15 wherein said insulating piercing portions of each of said plurality of first plug contacts is disposed closer to said second end wall then the insulation piercing portions of each of said plurality of second plug contacts.

17. The plug as set forth in claim 15 wherein said cable includes cable shielding means and wherein said plug includes plug shielding means having finger means to contact the cable shielding means.

* * * * *